US006749454B2

(12) United States Patent
Schmidt et al.

(10) Patent No.: US 6,749,454 B2
(45) Date of Patent: Jun. 15, 2004

(54) CONNECTOR WITH SNAP COLLAR

(75) Inventors: Werner Schmidt, Halver (DE); Rainer Daedelow, Werdohl (DE); Karsten Gembruch, Kierspe (DE)

(73) Assignees: ESCHA Bauelemente GmbH, Halver (DE); Lumberg Automation Components GmbH & Co. KG, Schalksmühle (DE)

( * ) Notice: Subject to any disclaimer, the term of this patent is extended or adjusted under 35 U.S.C. 154(b) by 0 days.

(21) Appl. No.: 10/289,816

(22) Filed: Nov. 7, 2002

(65) Prior Publication Data

US 2003/0162431 A1 Aug. 28, 2003

(30) Foreign Application Priority Data

Nov. 9, 2001 (DE) ..... 101 55 569
Aug. 3, 2002 (DE) ..... 102 35 675

(51) Int. Cl.[7] ..... H01R 13/627
(52) U.S. Cl. ..... 439/350; 439/606
(58) Field of Search ..... 439/350, 349, 439/320, 321, 352, 606, 253, 254, 592, 598, 599, 600

(56) References Cited

U.S. PATENT DOCUMENTS 3,594,694 A * 7/1971 Clark ..... 439/131
3,953,098 A * 4/1976 Avery et al. ..... 439/258
4,134,634 A * 1/1979 Baur et al. ..... 439/352
4,166,664 A * 9/1979 Herrmann, Jr. ..... 439/258

FOREIGN PATENT DOCUMENTS

DE 9103441 7/1991
DE 10121675 11/2001

* cited by examiner

*Primary Examiner*—Ross Gushi
(74) *Attorney, Agent, or Firm*—Martin A. Farber

(57) ABSTRACT

A plug-in connection comprising a connector (1) for fitting onto a counter connector (2), contact elements (3) of the connector (1) entering into an electrical conducting connection with counter contact elements (4) of the counter connector (2), with a sleeve (7) which surrounds the contact elements (3) carried by a core (K) and forms a snap collar (18) for gripping behind a latching bead (27, 28) of the counter connector (2) and with a locking coupling (5) which is displaceable in the plugging direction and which, in a release position, allows radial escape of the snap collar (18) and, in a locking position, prevents it, the core (K) being made of a harder plastic than a casing (17) surrounding the core (K) with a spacing and forming a sleeve portion (7) which has peripheral interruptions (8 and 9) and on the inside of which the snap collar (18) of softer plastic is formed integrally with the casing (17).

22 Claims, 19 Drawing Sheets

CONNECTOR WITH SNAP COLLAR

FIELD AND BACKGROUND OF THE INVENTION

The invention relates to a connector for fitting onto a counter connector, contact elements of the connector entering into an electrical conducting connection with counter contact elements of the counter connector, with a sleeve which surrounds the contact elements carried by a core and forms a snap collar for gripping behind a latching bead of the counter connector and with a locking coupling which is displaceable in the plugging direction and which, in a release position, allows radial escape of the snap collar and, in a locking position, prevents it.

A connector of this type is described by DE 91 03 441.8 U. The locking coupling has in that case a peripheral shoulder which is disposed at its free end and, in the locking position, is located to the rear of the snap collar formed by the free end of the sleeve. The snap collar grips behind an annular bead of a sleeve of the counter-connector part. The counter-connector part has counter contact elements in the form of pins, which enter receptacles forming the contact elements of the connector. The receptacles are associated with a central socket of the connector, which forms the core. The locking coupling can be displaced from the locking position into a release position by axial displacement. In this release position, the annular shoulder is approximately level with the annular bead, with the result that the snap collar which grips behind the annular bead can escape radially, in order to be pushed over the annular bead when the two connectors are connected to each other or disconnected from each other.

DE 101 21 675, which was not published before the priority date, describes a plug-in connection of the same generic type in which the counter-connector part also has in addition to an annular bead a thread, with the result that there is increased compatibility even with those connectors which do not have a snap collar but a union nut which can be screwed onto the thread.

SUMMARY OF THE INVENTION

The invention is based on the object of developing the connector of the generic type along with the associated counter connector and also a plug-in connection comprising the connector and counter connector in a way enhancing its functional features.

The object is achieved by the invention wherein the core consists of a harder plastic than a casing surrounding the core and forms a sleeve portion which has peripheral interruptions and on the inside of which the snap collar of softer plastic is formed integrally with the casing. This configuration gives the sleeve forming the snap collar greater rigidity than the casing, since the sleeve largely consists of harder plastic. The capability of escaping radially is retained, since the sleeve portion formed by the harder plastic forms peripheral interruptions.

The invention also relates to the counter connector associated with the connector. A latching bead formed by the rim around the opening of a sleeve of the counter connector is pertinent.

The invention also relates to the plug-in connection comprising the connector and the counter connector.

The invention also provides advantageous developments and also independent solutions achieving the object. It is provided in particular that the core has at least one guide for the locking coupling, extending in the direction of displacement of the locking coupling, which guide has latching means at each end for latching the locking coupling in its two end positions. As a result of this configuration, the locking coupling can be freely pushed back and forth between its two end positions. The locking coupling also remains in one of its two end positions in each case, with the result that both the locking position and the release position are secured by latching. The guide may in this case be formed by a window or a groove which is associated with the outer wall of the sleeve portion formed by hard material. As a result of a central constriction of the groove or the window, a latching threshold is created. The guide is preferably preceded by a run-up slope. The guide pin has a corresponding counter run-up slope. As a result, simple assembly is ensured. The locking coupling can be pushed onto the sleeve in a simple form. It comes into latching engagement there when the guide pins enter the diametrically opposite grooves or windows. The snap collar itself is preferably formed by the soft plastics material of the casing. It extends over the entire peripheral length of the sleeve and is located in the region of the end face of the same. It may form the edge of an inner lining of the sleeve. The outer side of the sleeve is preferably not covered by soft plastics material. The peripheral interruptions which permit the radial escape of the snap collar are preferably formed by two slits, in particular lying diametrically opposite each other, which are open toward the end face of the sleeve portion. The two slits may be filled with soft plastic. Similarly, anchoring clearances disposed between the slits in the sleeve portion may be filled with soft plastic. Level with the guide pin on the inner wall of the locking coupling is a locking shoulder running part of the way around the periphery. This locking shoulder lies to the rear of the snap collar in the locking position, with the result that radial escape is made impossible. This locking shoulder is adjoined by a peripheral free space. This peripheral free space lies to the rear of the snap collar in the release position, with the result that the snap collar can escape there if it is lifted over the annular bead. To ensure the integral connection of the inner lining of the sleeve portion and the casing of the connector, the core consisting of hard plastic has one or more through-flow openings, through which the soft material can flow during the production of the connector by injection-molding. The through-flow openings are preferably associated with a region which is located between the sleeve portion and a central region of the core, formed in particular in the manner of a socket. This intermediate region preferably forms an annular gap for receiving a sleeve of the counter-connector part provided with a thread, on which sleeve the annular bead is located at the end face. The bottom of this annular gap preferably likewise consists of soft plastic. This soft plastic support, which is adjoined by the inner lining, covers the through-flow opening. The connector part may be both female and male, depending on whether the counter connector is a male or female connector. The central socket may be both solid and hollow. It is hollow to receive the socket of a counter connector. The counter connector is, in particular, part of a sensor, for example a proximity switch. It may also be part of a distributor. The threaded sleeve may be screwed, clipped or pressed into the housing of the sensor or the distributor. The portion forming the annular bead may protrude outward beyond the threaded surface.

A variant of an independent character provides that on the sleeve, which may also have a casing as an inner lining, there is formed an extension which, in the locking position of the locking coupling, is enclosed by the latter. This axial extension of the sleeve serves for stabilizing the plug-in connection of the connector with the counter connector. It is advantageous if the extension is formed on a casing forming the snap collar. The stability is increased in particular by a bead which extends in the circumferential direction being formed on the extension at the end of the latter.

This bead may protrude radially outward. The extension of the sleeve may then come to lie against the sleeve of the counter connector in an extended region. Then, only a relatively small gap remains between the bead formed by the extension and the outer edge of the locking coupling, with the result that the play for movement between counter connector and connector transversely to the axial direction is restricted. A multi-layered overlapping region is obtained over an extended axial portion in the region of the contact point. The extension may be divided into two by means of two diametrically opposite axial slits. This permits radial escape in a simple way if it is required. The two axial slits also assist the snapping function of the snap collar.

BRIEF DESCRIPTION OF THE DRAWING

Exemplary embodiments of the invention are explained below on the basis of the drawings, in which.

DETAILED DESCRIPTION OF THE PREFERRED EMBODIMENT

Figure 1:
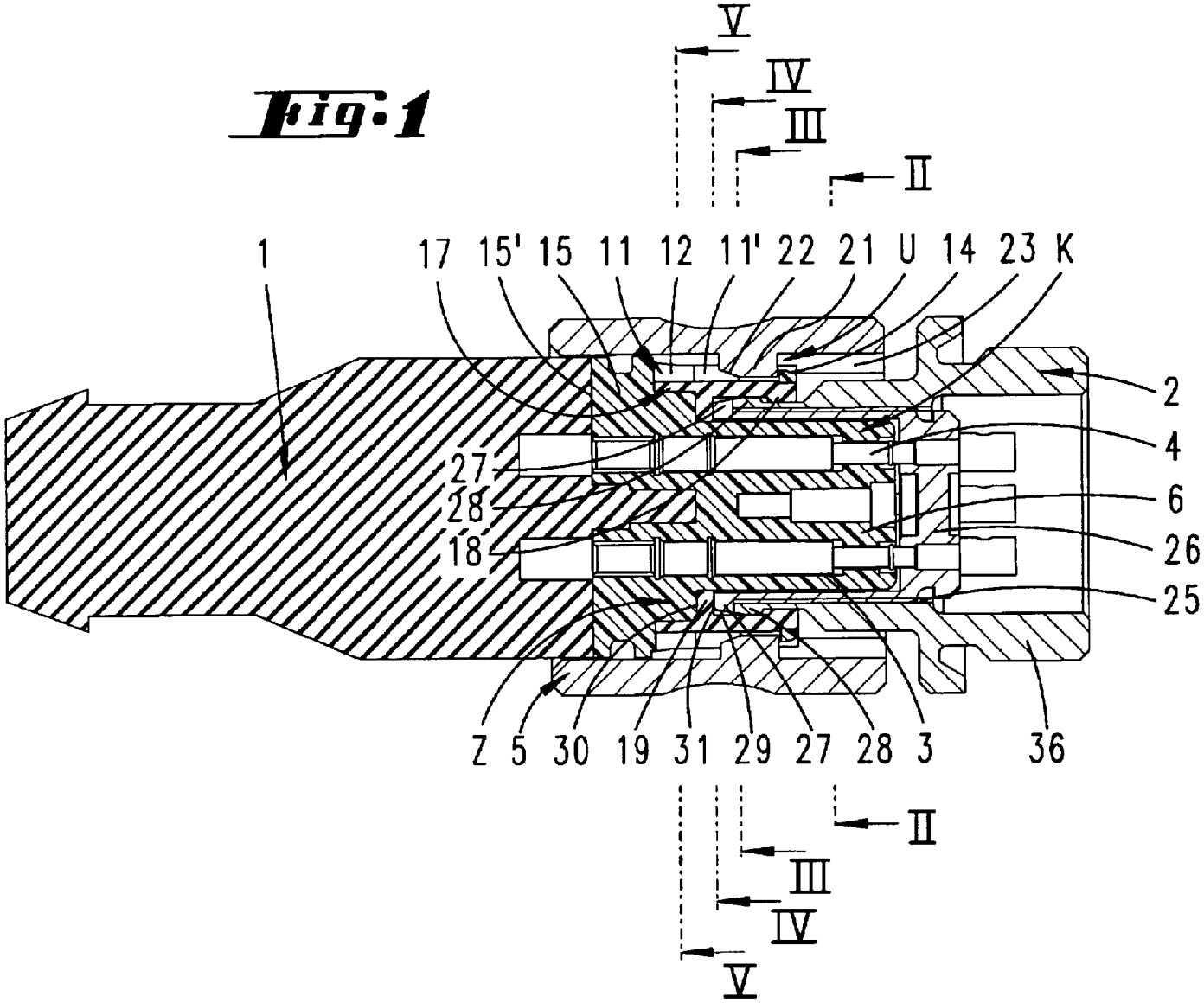
FIG. 1 shows a longitudinal section through a first exemplary embodiment of an electrical plug-in connection in a locking position.
Figure 2:
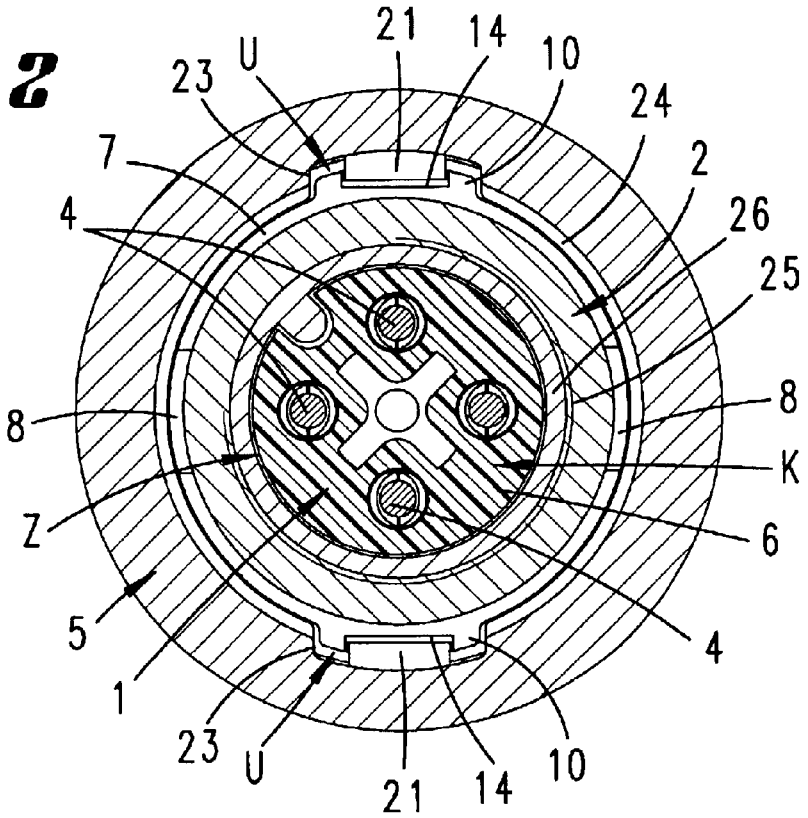
FIG. 2 shows the section along the line II—II in FIG. 1.
Figure 3:
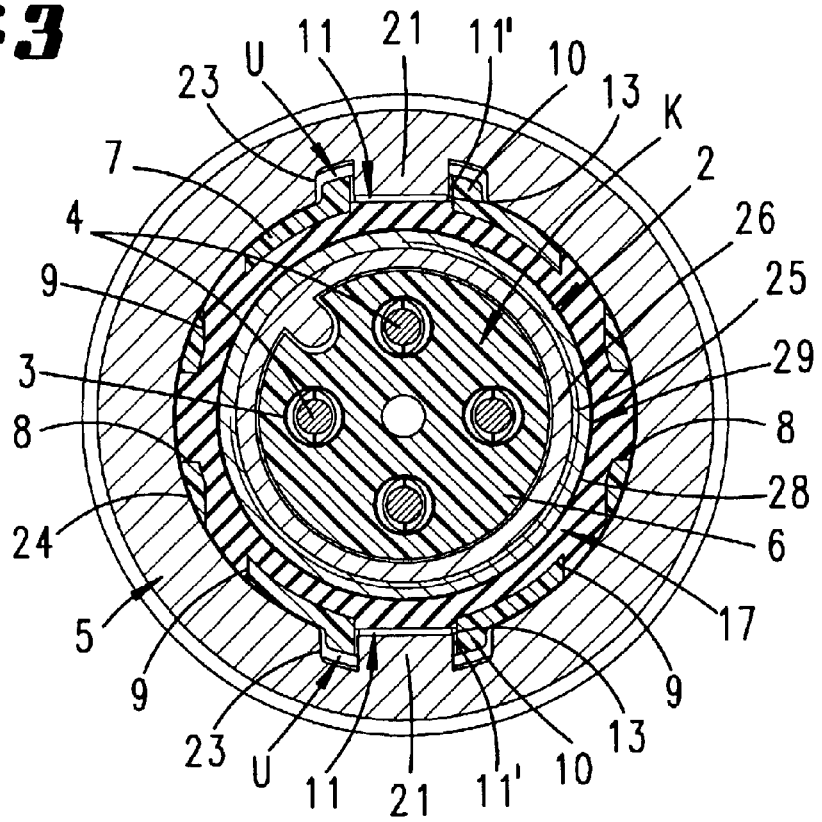
FIG. 3 shows the section along the line III—III in FIG. 1.
Figure 4:
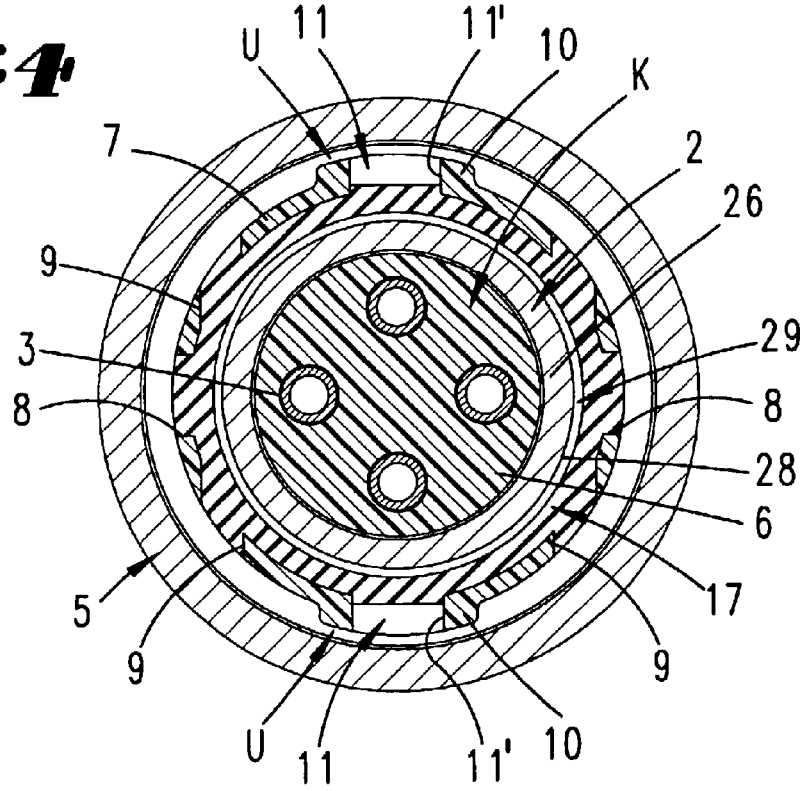
FIG. 4 shows the section along the line IV—IV in FIG. 1.
Figure 5:
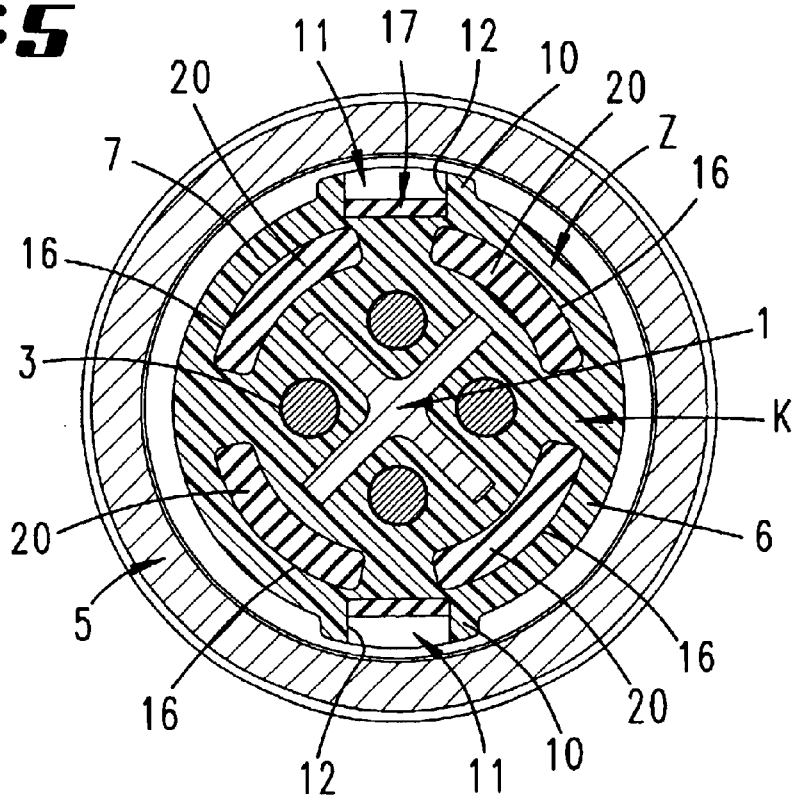
FIG. 5 shows the section along the line V—V in FIG. 1.
Figure 6:
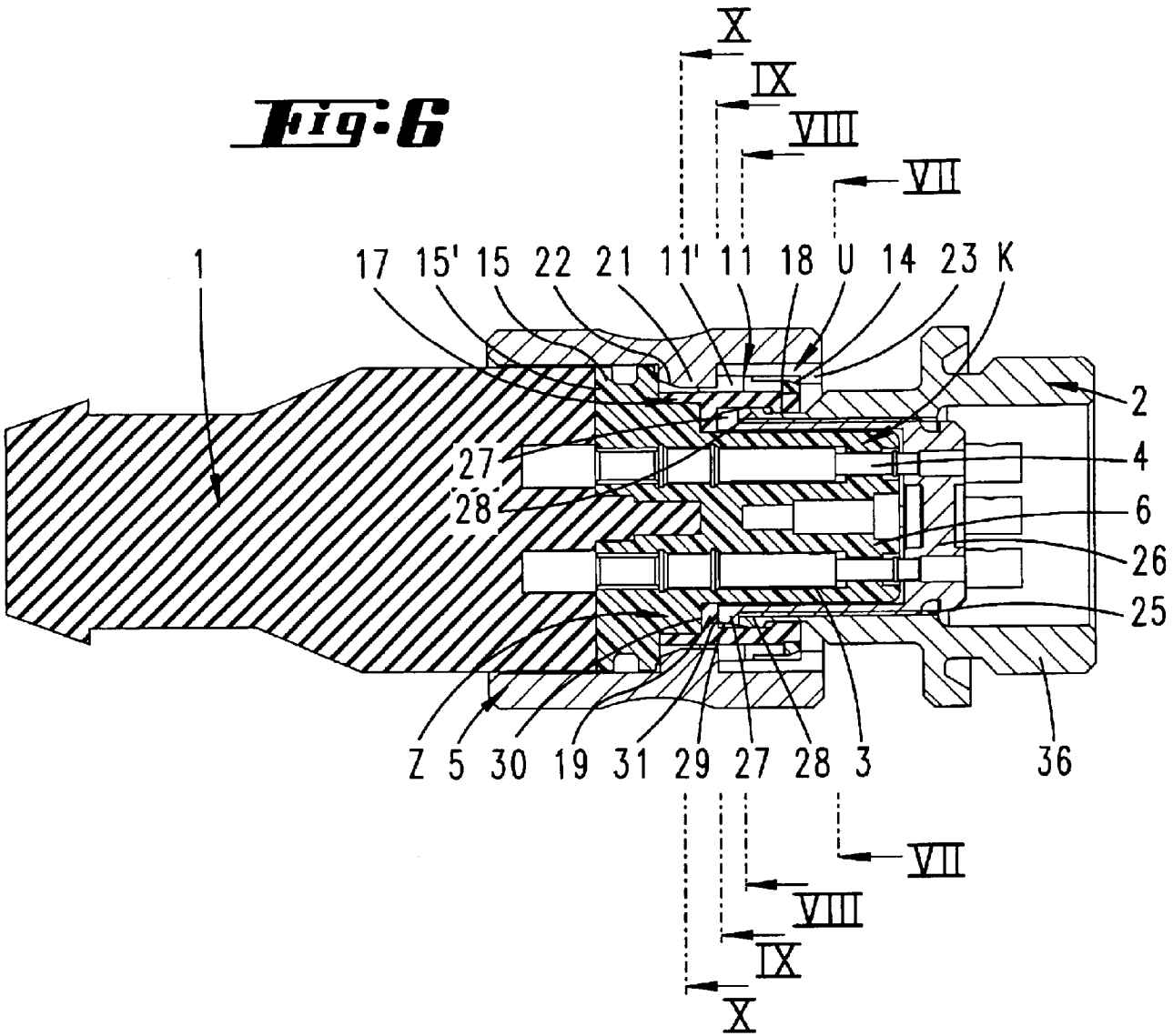
FIG. 6 shows a longitudinal section according to FIG. 1, but in a release position.
Figure 7:
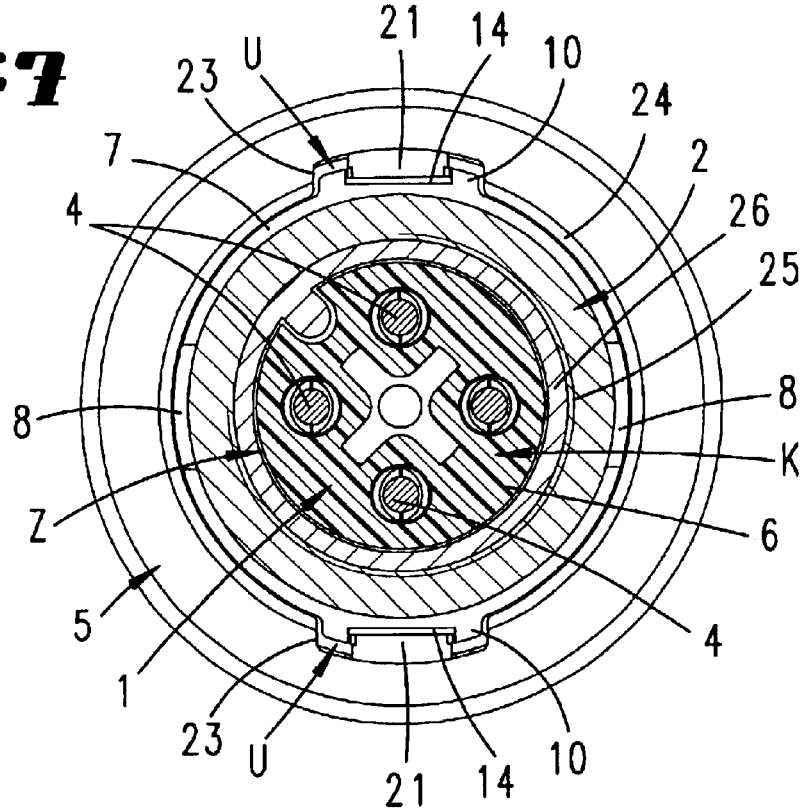
FIG. 7 shows the section along the line VII—VII in FIG. 6.
Figure 8:
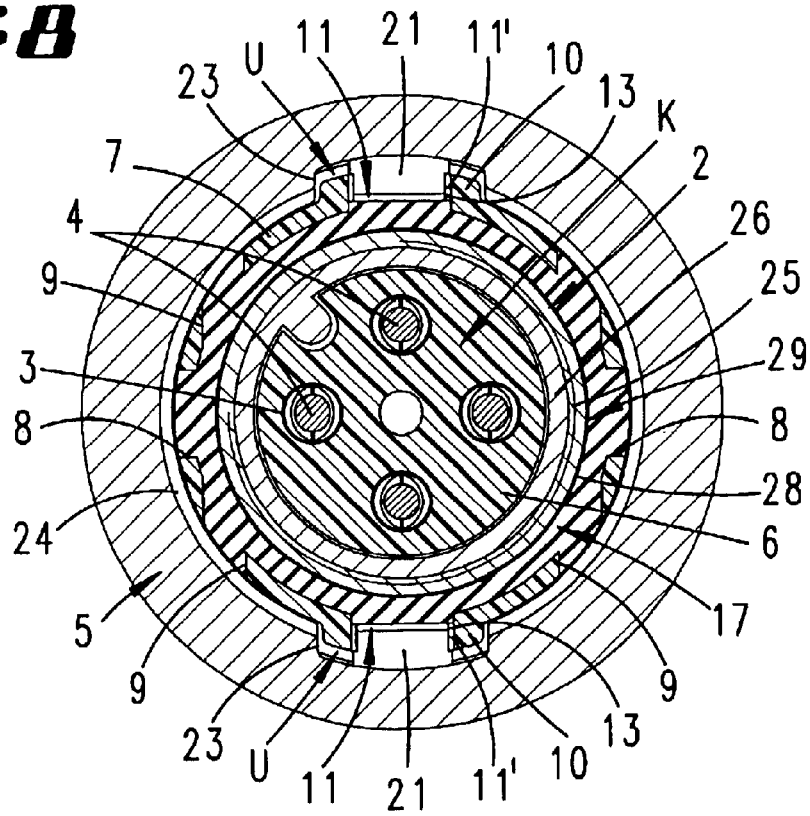
FIG. 8 shows the section along the line VIII—VIII in FIG. 6.
Figure 9:
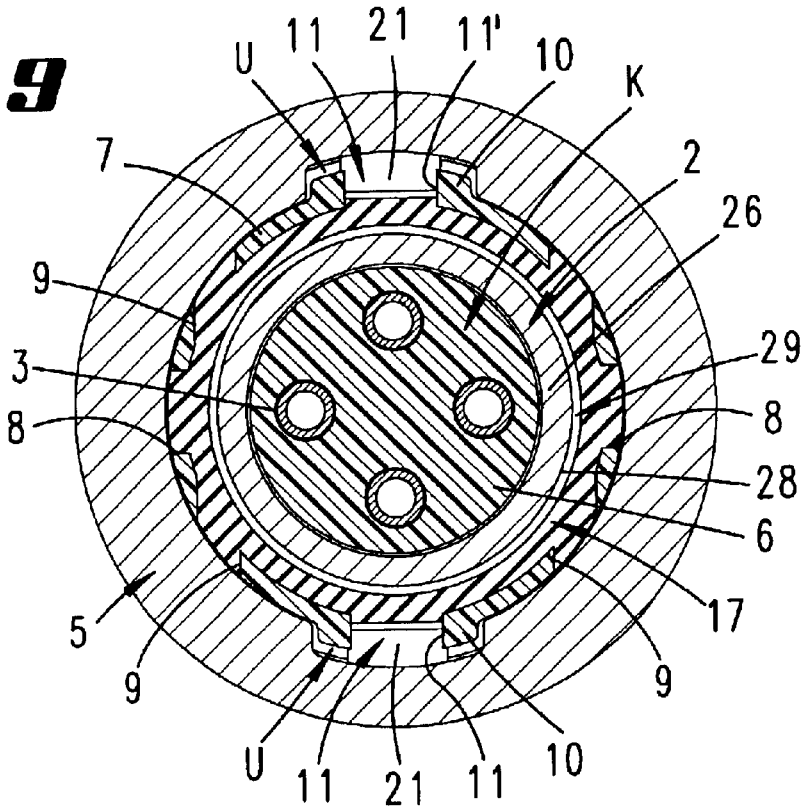
FIG. 9 shows the section along the line IX—IX in FIG. 6.
Figure 10:
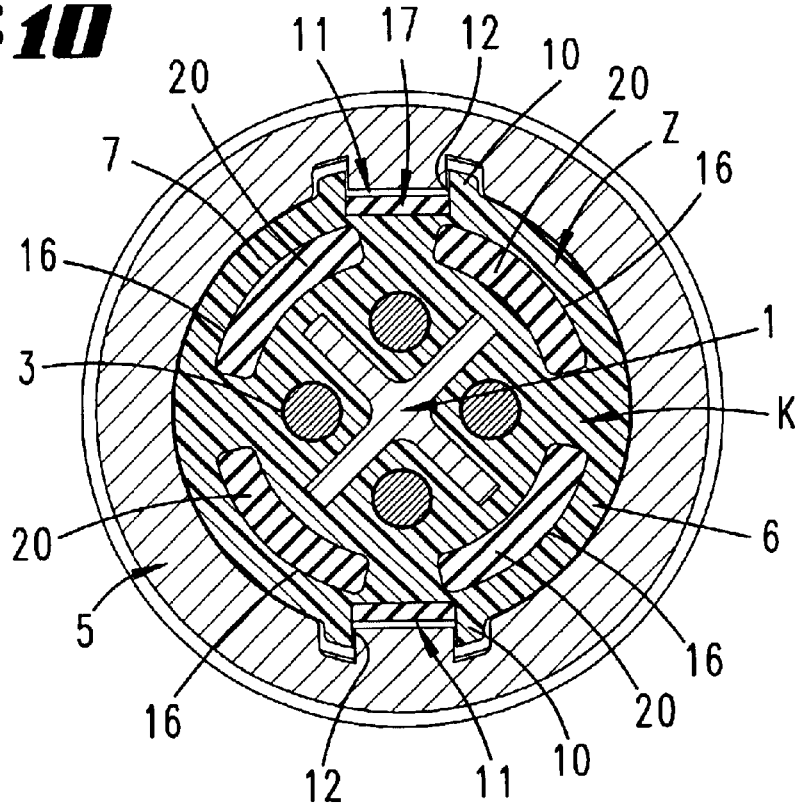
FIG. 10 shows the section along the line X—X in FIG. 6.
Figure 11:
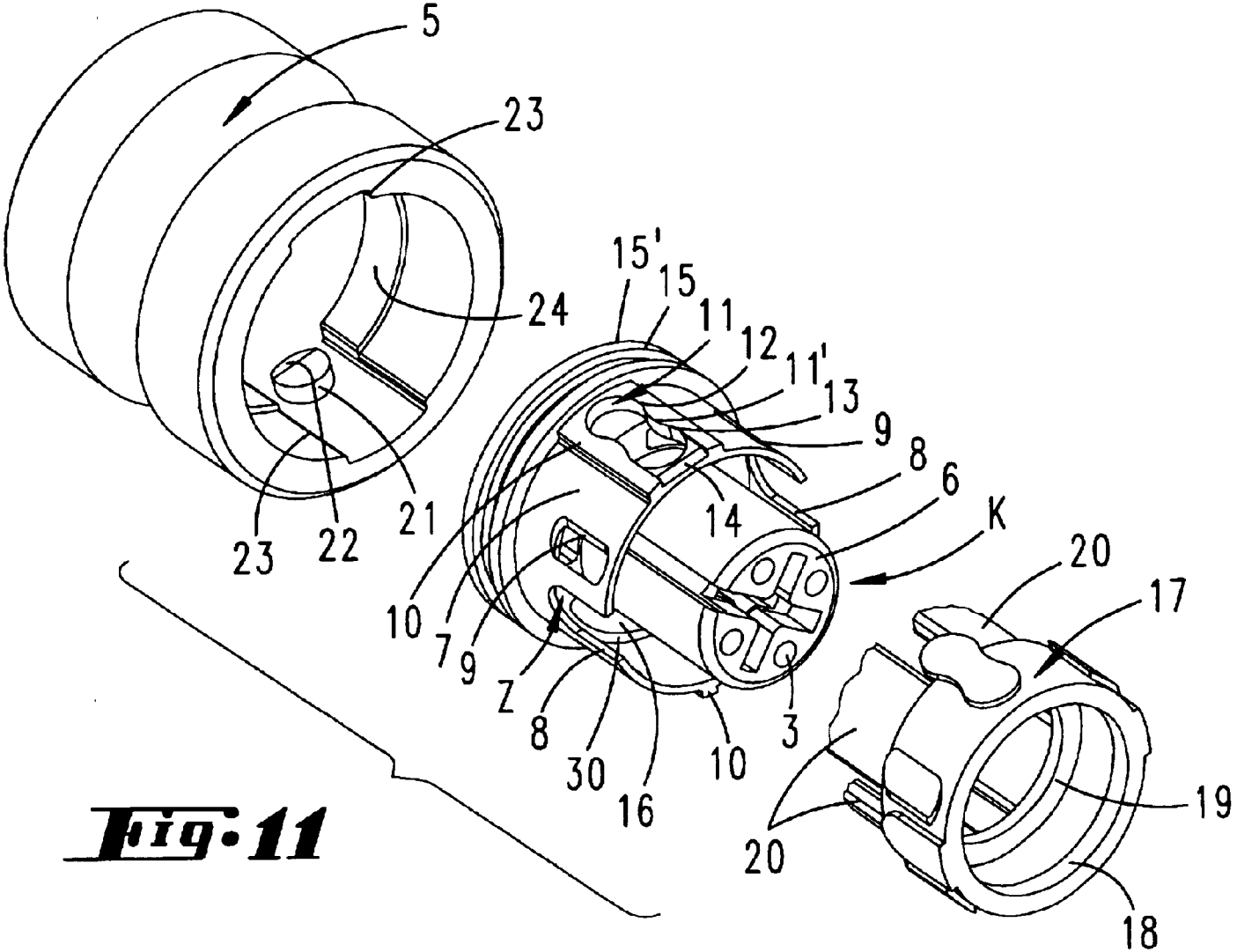
FIG. 11 shows an exploded perspective view representing the main elements of the connector, the soft plastic casing which is firmly connected to the hard plastic core being shown detached from the latter for the purposes of illustration.
Figure 12:
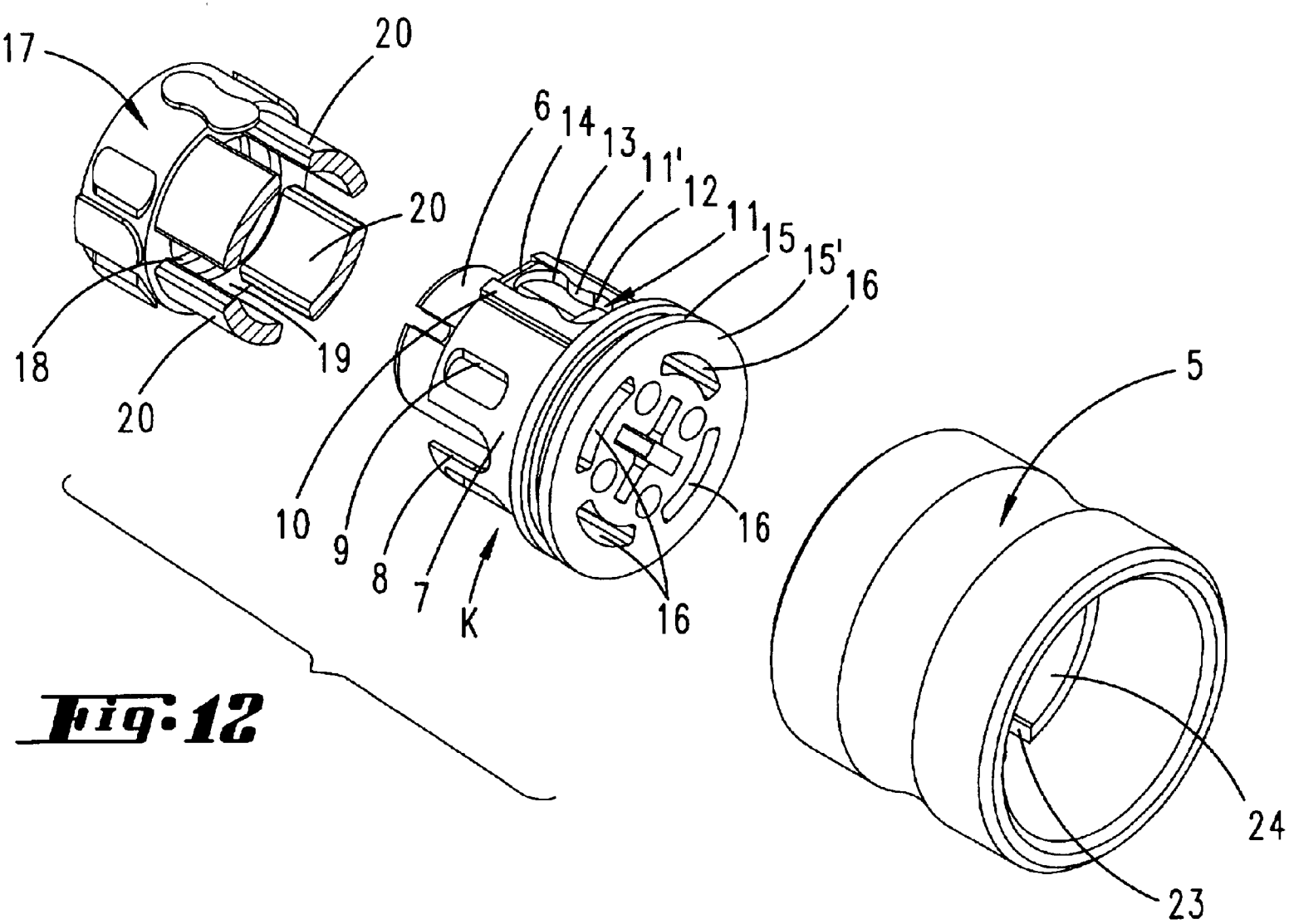
FIG. 12 shows an exploded perspective view according to FIG. 11, but turned through 180°.
Figure 13:
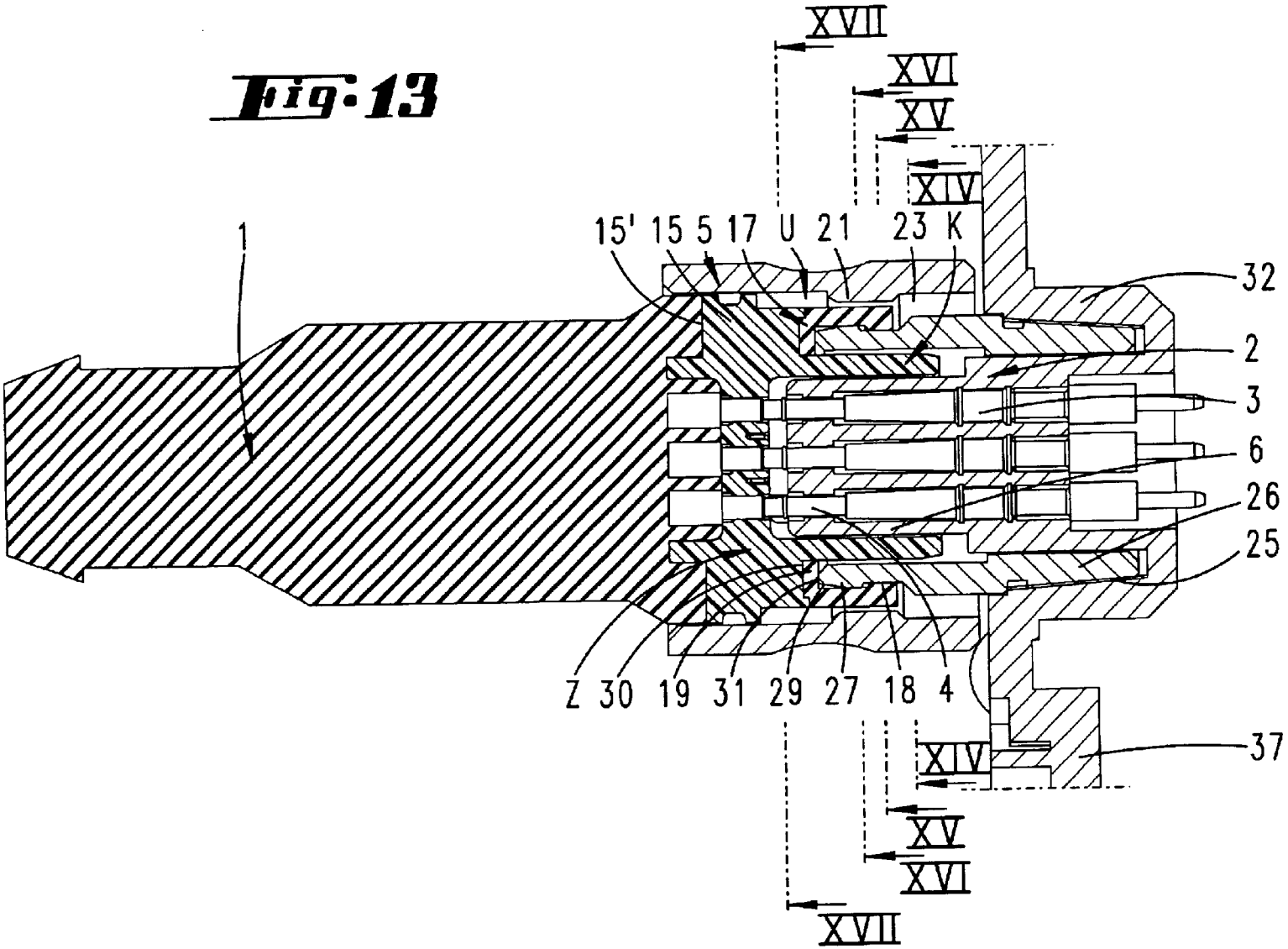
FIG. 13 shows a longitudinal section through a second exemplary embodiment of an electrical plug-in connection in a locking position.
Figure 14:
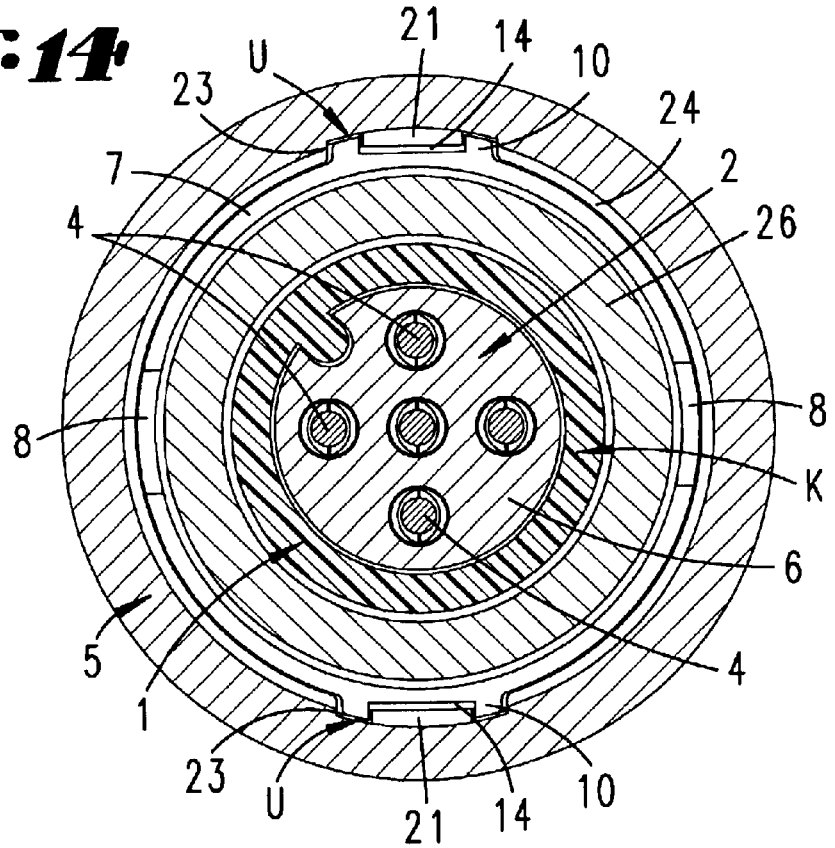
FIG. 14 shows the section along the line XIV—XIV in FIG. 13.
Figure 15:
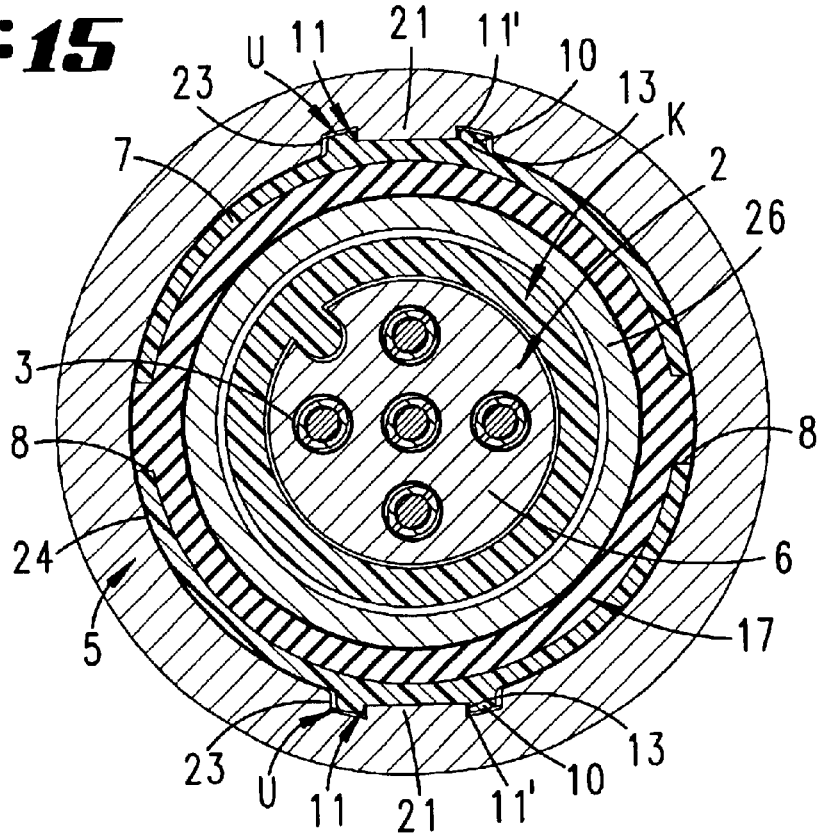
FIG. 15 shows the section along the line XV—XV in FIG. 13.
Figure 16:
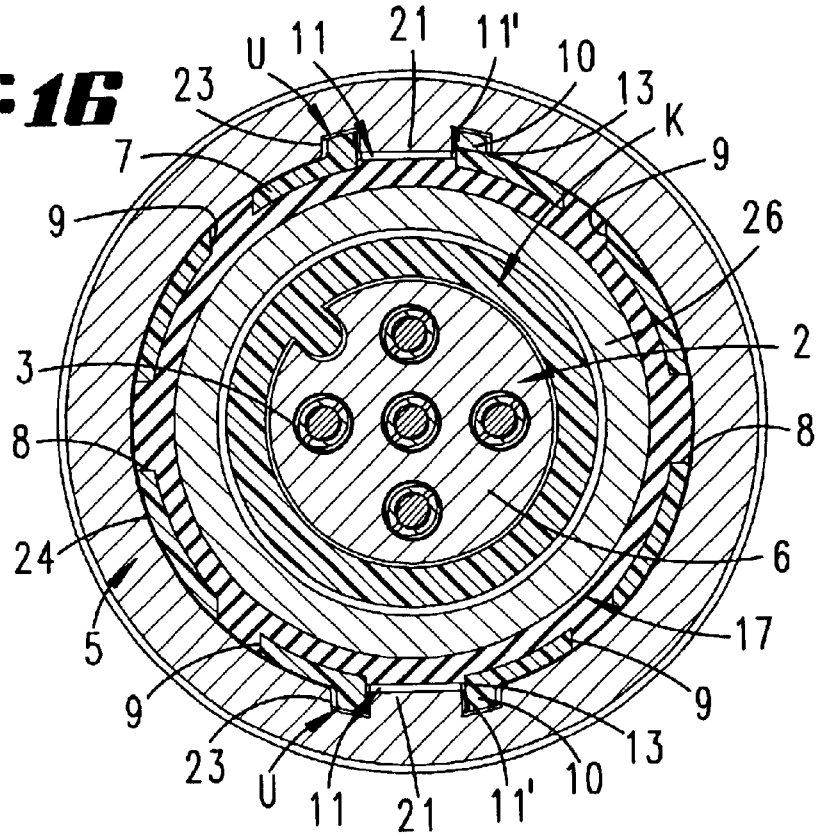
FIG. 16 shows the section along the line XVI—XVI in FIG. 13.
Figure 17:
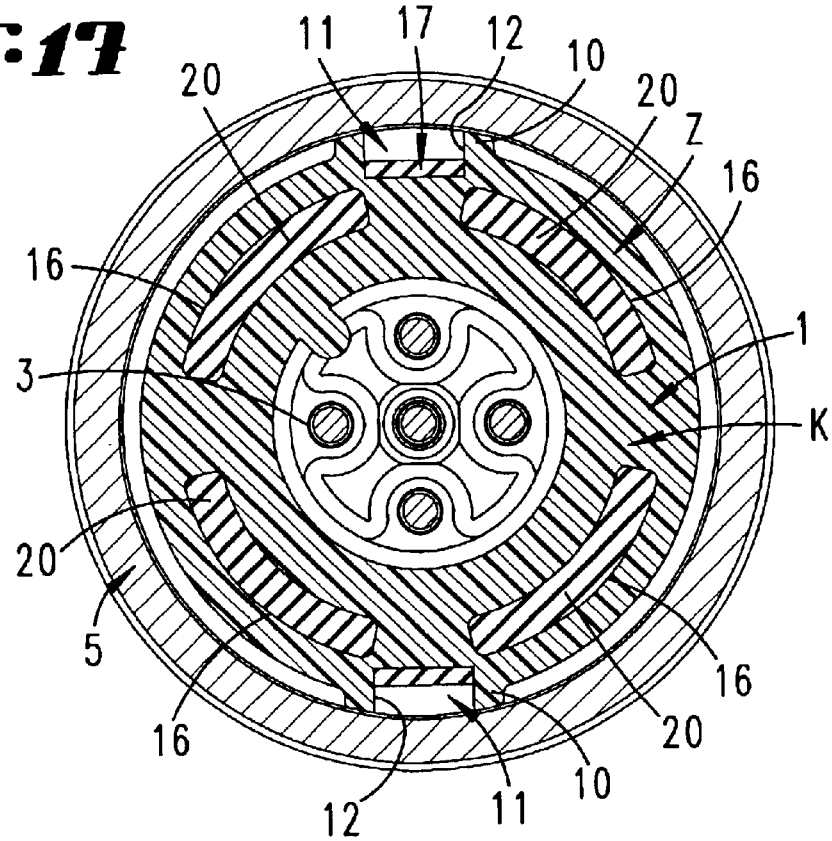
FIG. 17 shows the section along the line XVII—XVII in FIG. 13.

The first exemplary embodiment, represented in FIGS. 1 to 12, is an electrical plug-in connection with contact elements 4 in the form of pins, which are located on the counter connector 2, the connecting cables necessary for this purpose not being represented. FIGS. 13 to 22 show a second exemplary embodiment of an electrical plug-in connection, the contact elements 4 in the form of pins being located on the connector 1.

The plug-in connection specifically comprises a connector 1 and a counter connector 2, the connector 1 and the counter connector 2 being able to be fitted together. To establish an electrical conducting connection between connector 1 and counter connector 2, the connector 1 of the first exemplary embodiment has a plurality of receptacles 3 forming contact elements which are remote from its end on the cable side and extend parallel to the plugging axis. The counter connector 2 has, corresponding to these receptacles, a plurality of axially protruding pins 4, forming counter contact elements. The pins 4 inserted into the corresponding receptacles 3 form an electrical conducting connection. The pins 4 originate from the bottom of a cup. In this cup, a socket 6 which accommodates the receptacles 3 in cavities can be inserted. To secure this plug-in connection, a locking coupling 5 which is displaceable in the plugging direction is provided.

One end of the connector 1, which is enclosed by the locking coupling 5, forms a core K with a socket 6 of smaller diameter in comparison with the outside diameter of the connector 1. This socket has the receptacles 3, which have been introduced in the axial direction. The socket 6 is partly surrounded, with a radial spacing, by a sleeve portion 7 of identical material, formed by the core K and of a larger diameter. The core K consists of hard plastic, a plastics injection-molding process being used for production. The sleeve portion 7 has peripheral interruptions, on the one hand in the form of grooves 8 made radially, lying diametrically opposite each other and open toward the edge, and on the other hand in the form of windows 9 made in the form of secants and lying diametrically opposite each other. Furthermore, the sleeve portion 7 has, disposed centrally in relation to the grooves 8, radially protruding, diametrically opposite guide sockets 10. The guide sockets 10 are penetrated by radially made guides 11, which have a base outline in the form of a cat's tongue. As a result of the central constriction 11', projections protruding into the clearances are formed by the edges running in the axial direction, with the result that latching means 12 and 13 are formed. Starting from the free end edge of the guide socket 10, the clearance 13 is respectively preceded by a run-up slope 14, which runs transversely in relation to the guide 11. The width of the nm-up slopes 14 corresponds to the width of the guides 11, the run-up slopes 14 ending somewhat below the outer casing surface of the guide sockets 10.

It is provided according to the invention that the socket 6 and the sleeve portion 7 originate from a cylindrical base body 15 which is of identical material and is formed by the core K. In this case, the outside diameter of the base body 15 is made to be somewhat smaller than the inside diameter of the locking coupling 5. In keeping with this, the base body 15 forms with its outer casing surface a sliding portion region for the locking coupling 5. Furthermore, the base body 15 has on its end face 15', remote from the sleeve portion 7, axially disposed through-flow openings 16, which open out in a central region Z, which is in particular in the form of a socket. This circular central region Z is bounded on the one hand by the inner wall of the sleeve portion 7 and on the other hand by the outer casing surface of the socket 6. The through-flow openings 16 are disposed in the central region Z in the form of segments of a circle.

In an advantageous way, a soft plastic portion is molded onto the core K, that is the central region Z, of the connector 1, by means of an injection-molding process. The soft plastics material can flow through the through-flow openings 16. After solidifying, this soft plastics material forms not only a casing 17, which is disposed in the central region Z and hugs the inner sleeve wall, but also the cable sheathing of the grip portion of the connector 1. Consequently, the inner wall of the sleeve portion 7 is lined with soft plastic, but the outer casing side of the sleeve portion 7 is substantially free from soft plastic. In addition, the grooves 8, or the windows 9 disposed in the form of secants, are filled with soft plastic, to be precise in such a way that the soft plastics material extends up to the outer casing surface of the sleeve portion 7 and forms a termination with the outer casing surface. By contrast with this, the radially disposed guides 11 are filled only to about one third of their wall thickness, cf. in particular the representations in FIGS. 3 and 8.

In the region of the free end face edge which is associated with the plug-in opening, the casing 17 has an inwardly protruding snap collar 18 of identical material running around it. The bottom of the central region Z, that is the region from which the socket 6 originates, is covered over by a soft plastic support 19 which is formed onto the inner side of the casing 17 and is of identical material. The soft plastic support 19 has the form of an annular collar, from which axially aligned casing feet 20 in the form of segments of a circle originate. On account of being introduced by the injection-moulding process, the casing feet 20 fill the through-flow openings 16 of the hard plastic base body 15. Accordingly, the casing feet 20 anchor the soft plastic arrangement in the through-flow openings 16. They establish a positive connection with the connector 1, cf. in particular the representation in FIG. 5.

As already mentioned at the beginning, the connector 1 is enclosed in the region of the insertion opening by the locking coupling 5 and is guided in such a way that it can be latched in the direction of displacement. For this purpose, the locking coupling 5 has two guide pins 21, which protrude inward from the inner wall, transversely in relation to the locking direction, have run-up slopes 22 at their free extreme ends and are disposed at the end of two axially made guide grooves 23. The inside diameter of the guide grooves 23 is made larger than the outside diameter of the guide sockets 10. Beginning at the flanks of the guide grooves 23, there is level with the guide pins 21 in each case in the circumferential direction a locking shoulder 24 running part of the way around the periphery, the inside diameter of which is made only slightly larger than the outside diameter of the sleeve portion 7.

The locking coupling 5 is clipped onto the connector 1 in the direction of displacement. In this case, the run-up slopes 22 of the guide pins 21 run over the run-up slopes 14 of the guide sockets 10. After running over the run-up slopes 14, the guide pins 21 engage in the clearances 13. Consequently, only a stop-limited axial displacement of the locking coupling 5 is then possible.

To fit the connector 1 onto the counter connector 2, the locking coupling 5 must be brought into its release position. In the displacement required for this purpose, the guide pins 21 enter the latching clearances 12, the end faces of the guide pins 21 sliding over the outer surface of the casing 17 without touching it.

In the exemplary embodiment of FIGS. 1 to 11, the counter connector 2 is of a two-part form. It forms a cup, in which the socket 6 can be inserted. In this embodiment, this cup is formed by a sleeve 26, from the bottom of which the counter contact elements originate in the form of pins 4. The sleeve 26 is connected by means of a thread 25 to an outer sleeve 36. The sleeve 36 may consist of metal and have an internal thread 25. The sleeve 26, which consists of plastic and forms the cup, can be screwed into this internal thread. The end edge of the outer sleeve 36, which forms part of the annular bead 28, is enclosed by a collar of the inner sleeve 26. This collar forms part of the annular bead 27. The snap collar 18 can consequently enter an annular clearance of the outer sleeve 36.

To bring the connector 1 into a coupling position with the counter connector 2, the socket 6 of the connector 1 is pushed into the clearance of the counter connector 2, the pins 4 then entering the receptacles 3 of the connector 1. This is accompanied by the annular beads 27 and 28 running over the snap collar 18, which can for this purpose escape into the peripheral free space U. The counter connector 2 then enters with the annular beads 27 and 28 an annular gap 29, which is bounded on the one hand by the outer casing surface of the socket 6 and on the other hand by the inner wall of the casing 17. The bottom 30 of the annular gap 29 is covered over its surface area by the soft plastic support 19, this soft plastic support 19 forming a soft stop limitation for the end edge 31 of the counter connector 2. Before fitting together, the locking coupling 5 must be brought into a release position, in which the guide pins 21 lie in the latching clearances 12. Only then does the locking shoulder 24 no longer lie to the rear of the snap collar 18, with the result that the peripheral free space U is released, so that the sleeve portion 7 in the region of the snap collar 18 can escape radially outward by acting on the annular beads 27 and 28. Subsequently, the locking coupling 5 is brought into the closure position again, its guide pins 21 moving over the central constrictions 11' and entering the latching clearance 13, cf. in particular the representation in FIG. 1. In this locking position, the locking shoulder 24 lies in the region of the snap collar 18, with the result that radial escape of the edge of the sleeve is prevented by the locking shoulder 24.

Like the two exemplary embodiments described above, the exemplary embodiment represented in FIGS. 23 to 26 has a core K of a harder plastic, the plastic being harder than the plastic of a casing 17 surrounding the core K with a spacing. Also provided in this embodiment is a snap collar 18, which consists of soft plastic and can enclose a bead 28 of a sleeve 26 of the counter connector 2.

Figure 27:
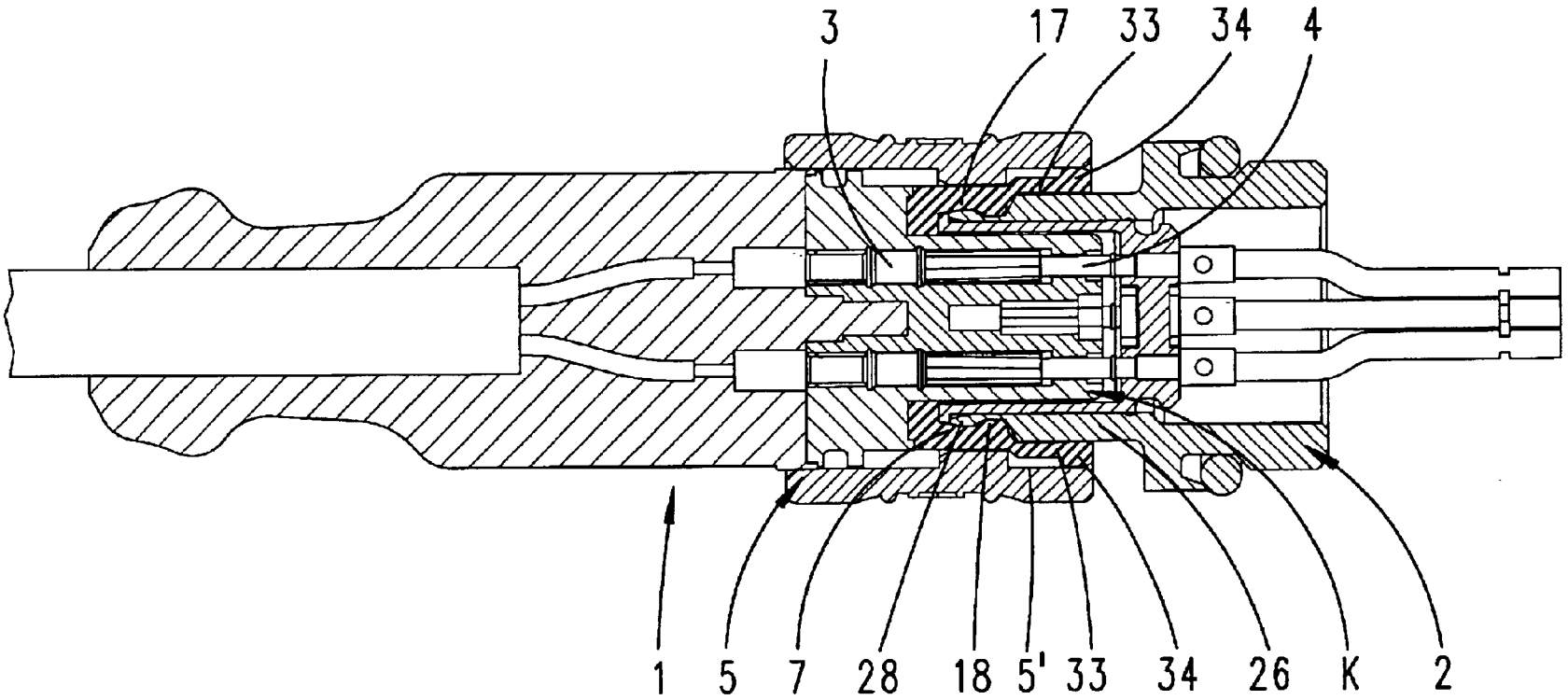
FIG. 27 shows the section along the line XXVII—XXVII in FIG. 25.

In the case of this exemplary embodiment, the sleeve 7 has an axial extension 33. In this embodiment, the axial extension 33 is associated with the casing 17. The axial extension 33 of the snap collar 18 is an integral extension of the casing 17 consisting of soft plastic. In the locking position of the locking coupling 5, the axial extension 33 is enclosed by the locking coupling 5 in such a way that the extreme end of the extension 33 is in line with the extreme end of the locking coupling 5, with the result that the axial extension 33 is disposed in the region of the end 5' of the locking coupling 5. In this region of the end 5', the extension 33 has a radially outwardly pointing bead 34. Between bead and inner wall of the locking coupling 5 there is only a small amount of play for movement. In the locking position, on the other hand, the inner wall of the axial extension 33 engages against the outer wall of the sleeve 26 of the counter connector 2. As FIG. 23 and the sectional representation of FIG. 26 reveal in particular, the axial extension 33 has two opposite axial slits, which extend up to the snap collar 18. As a result of these two axial slits 35, it is possible for the axial extension 33 to escape radially. As FIG. 27 reveals, the bead 34 fills the intermediate space between the end portion 5' of the locking sleeve 5 and the outer wall of the sleeve 26 of the counter connector 2. The overlapping region of the two connector parts 1, 2 is consequently extended, which increases the flexural rigidity of the plug-in connection. If a bending moment is applied to the plug-in connection, leverages can be transferred via the bead 34 from the locking coupling 5 to the sleeve 26.

Figure 18:
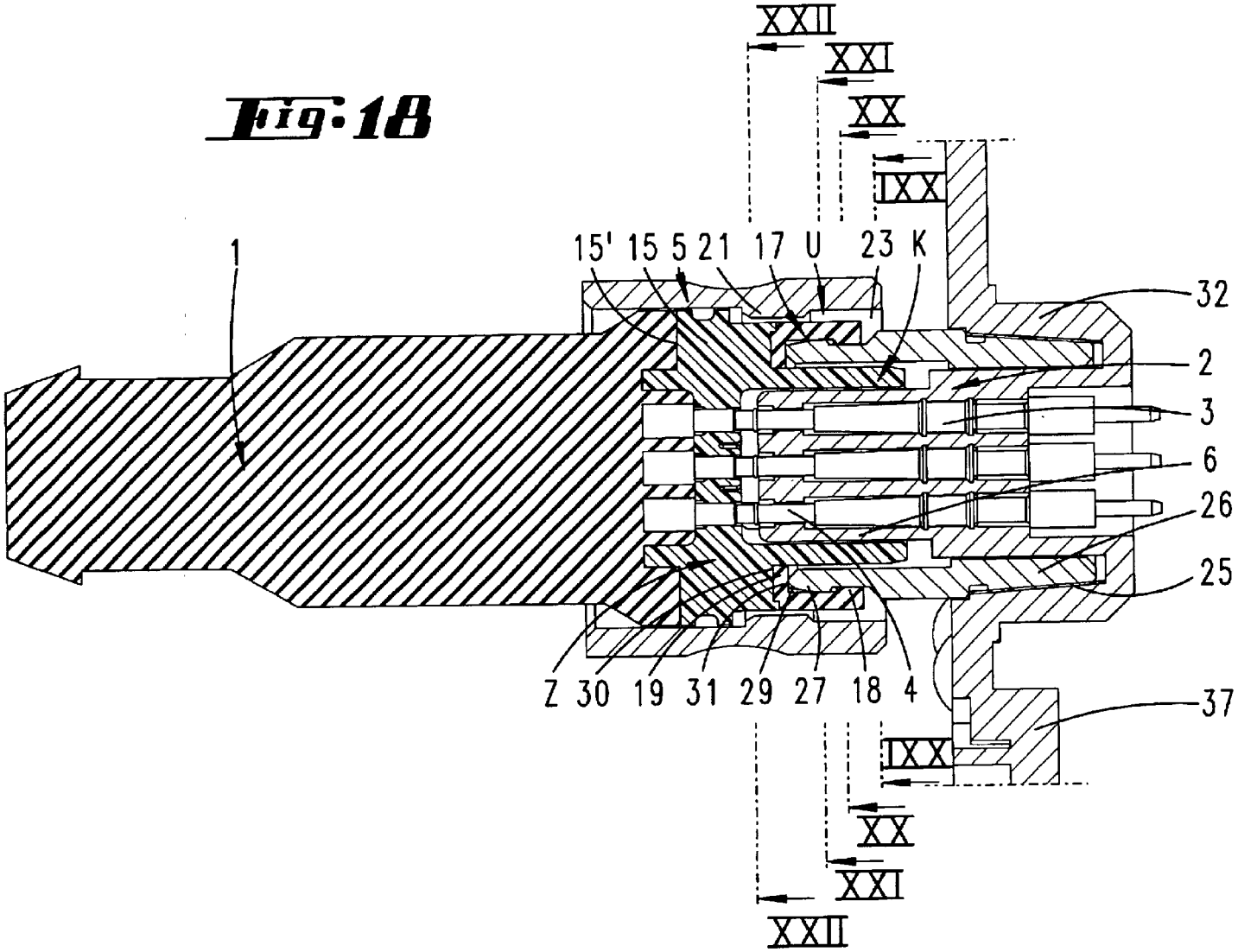
FIG. 18 shows a longitudinal section according to FIG. 13, but in a release position.
Figure 19:
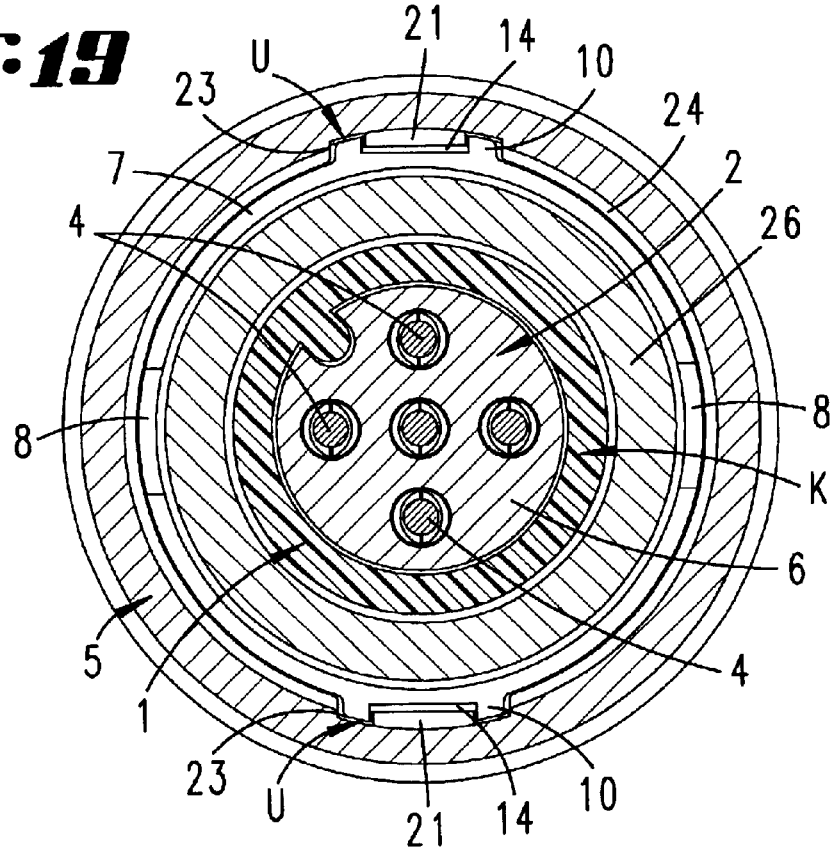
FIG. 19 shows the section along the line XIX—XIX in FIG. 18.
Figure 20:
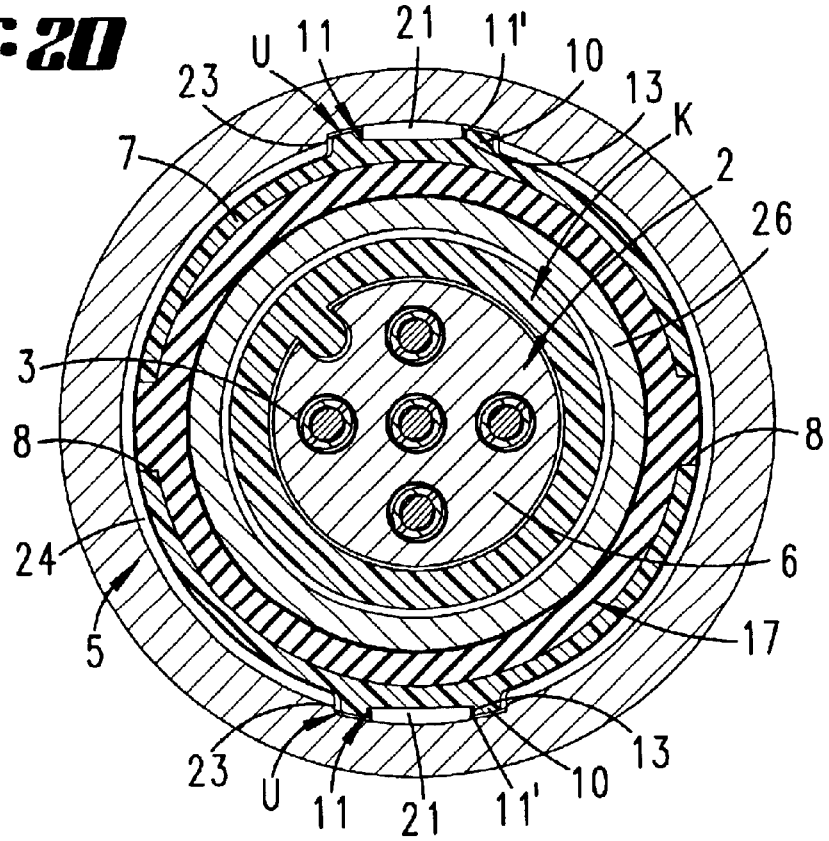
FIG. 20 shows the section along the line XX—XX in FIG. 18.
Figure 21:
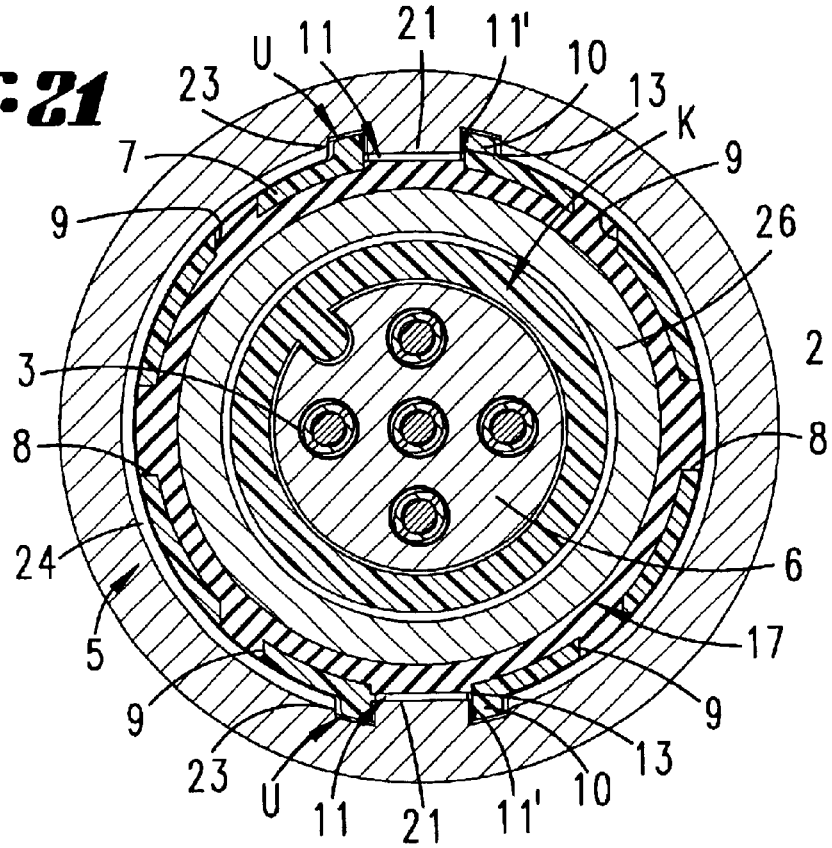
FIG. 21 shows the section along the line XXI—XXI in FIG. 18.
Figure 22:
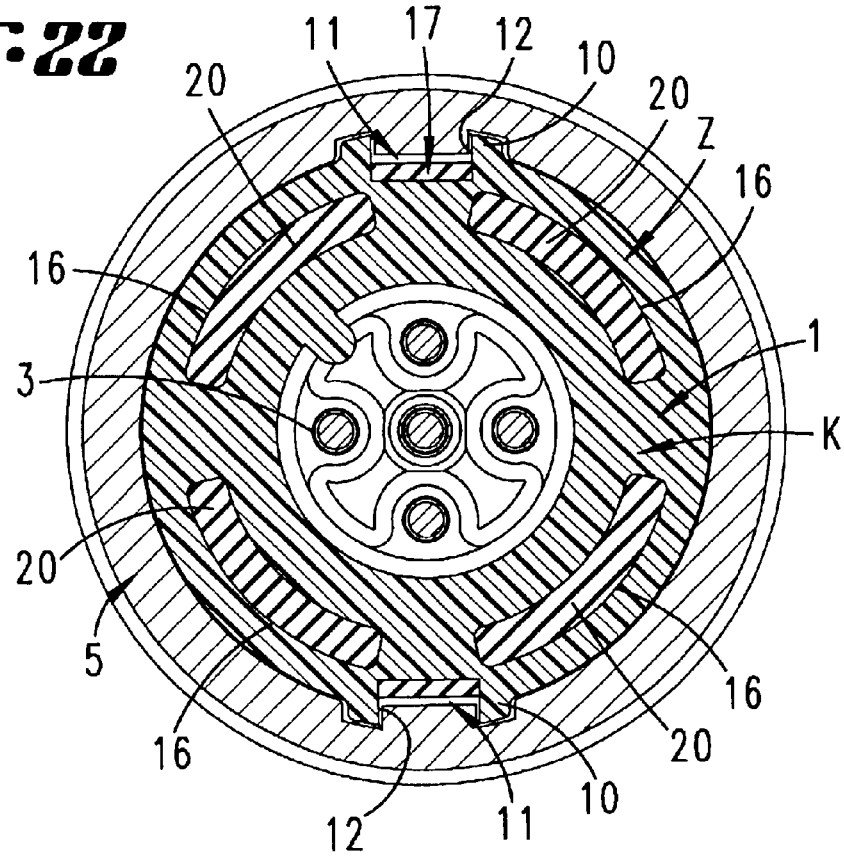
FIG. 22 shows the section along the line XXII—XXII in FIG. 18.
Figure 23:
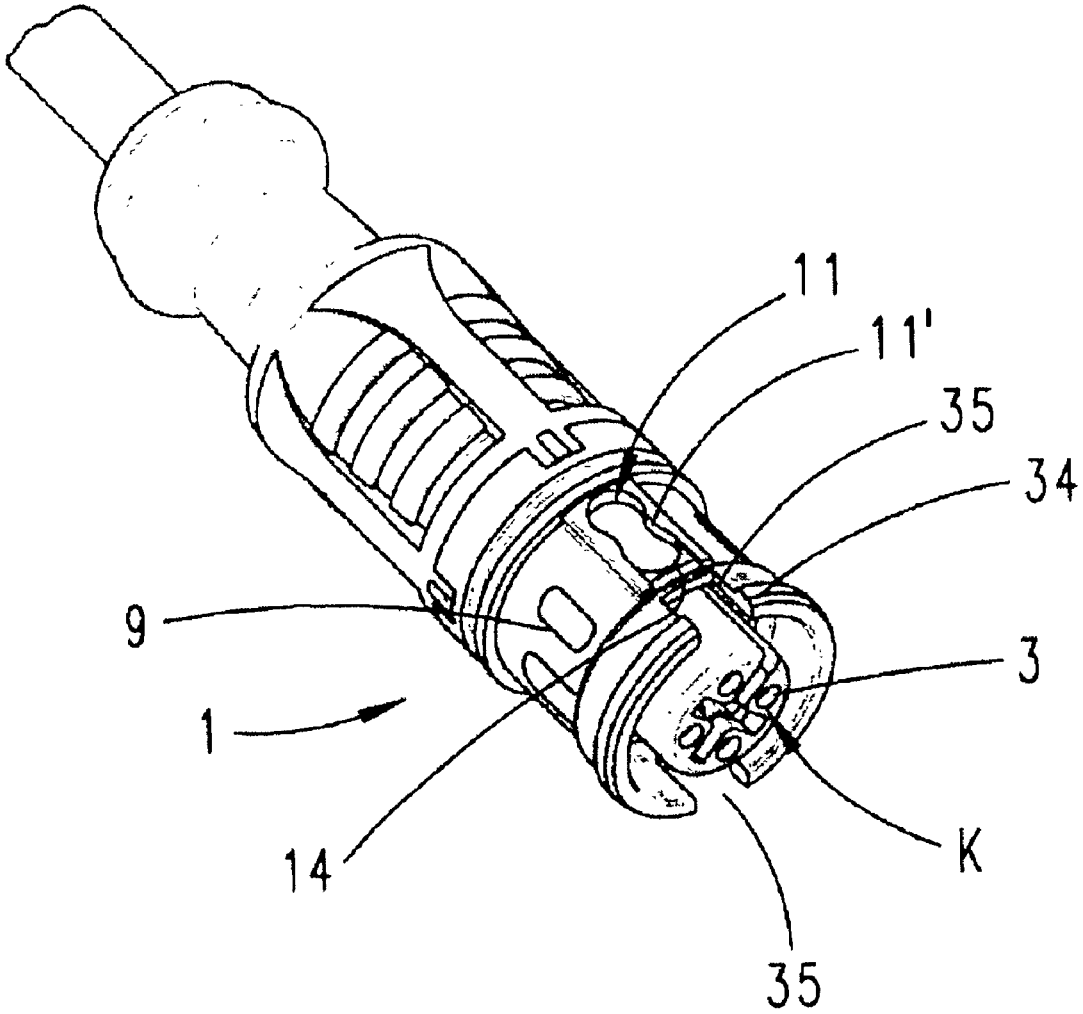
FIG. 23 shows the perspective representation of a further exemplary embodiment.
Figure 24:
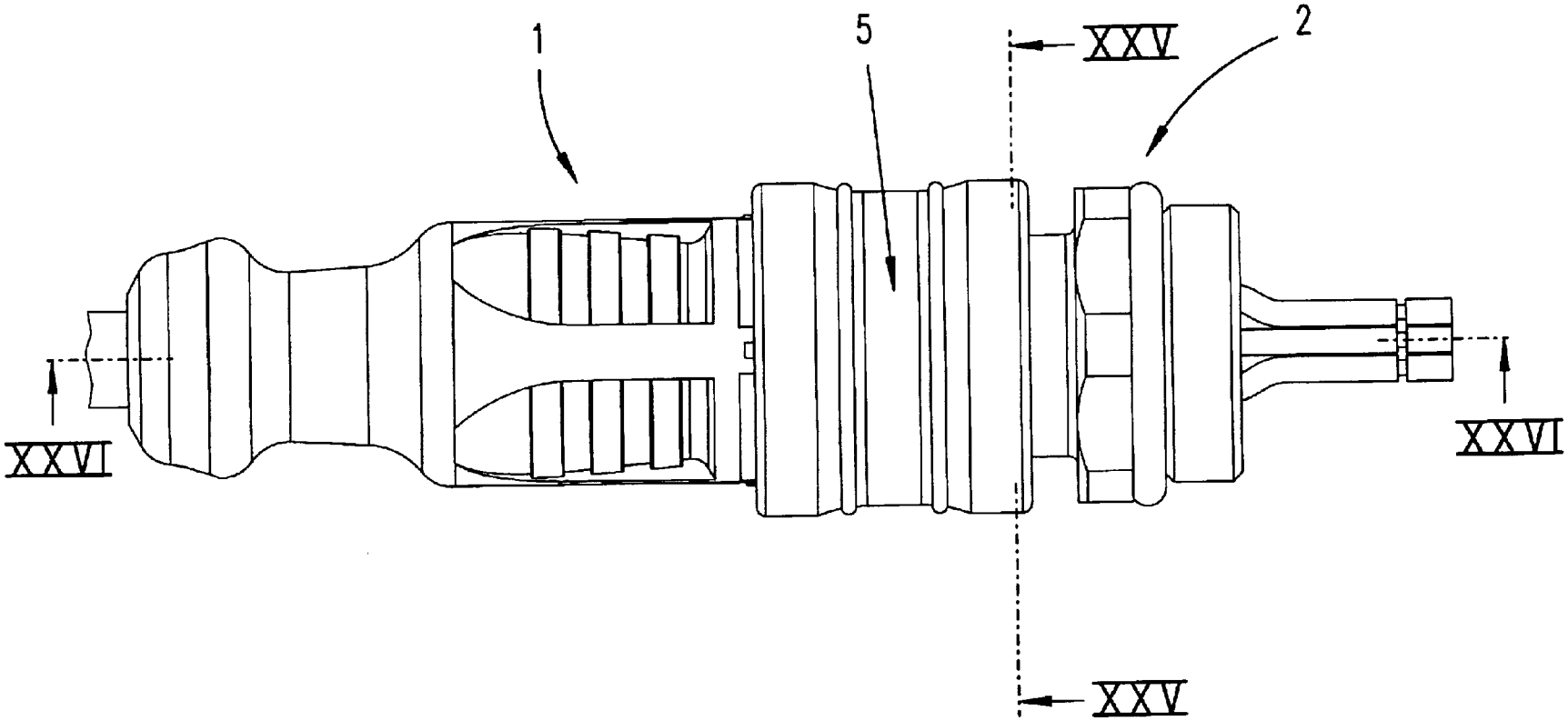
FIG. 24 shows the side view of the further exemplary embodiment.
Figure 25:
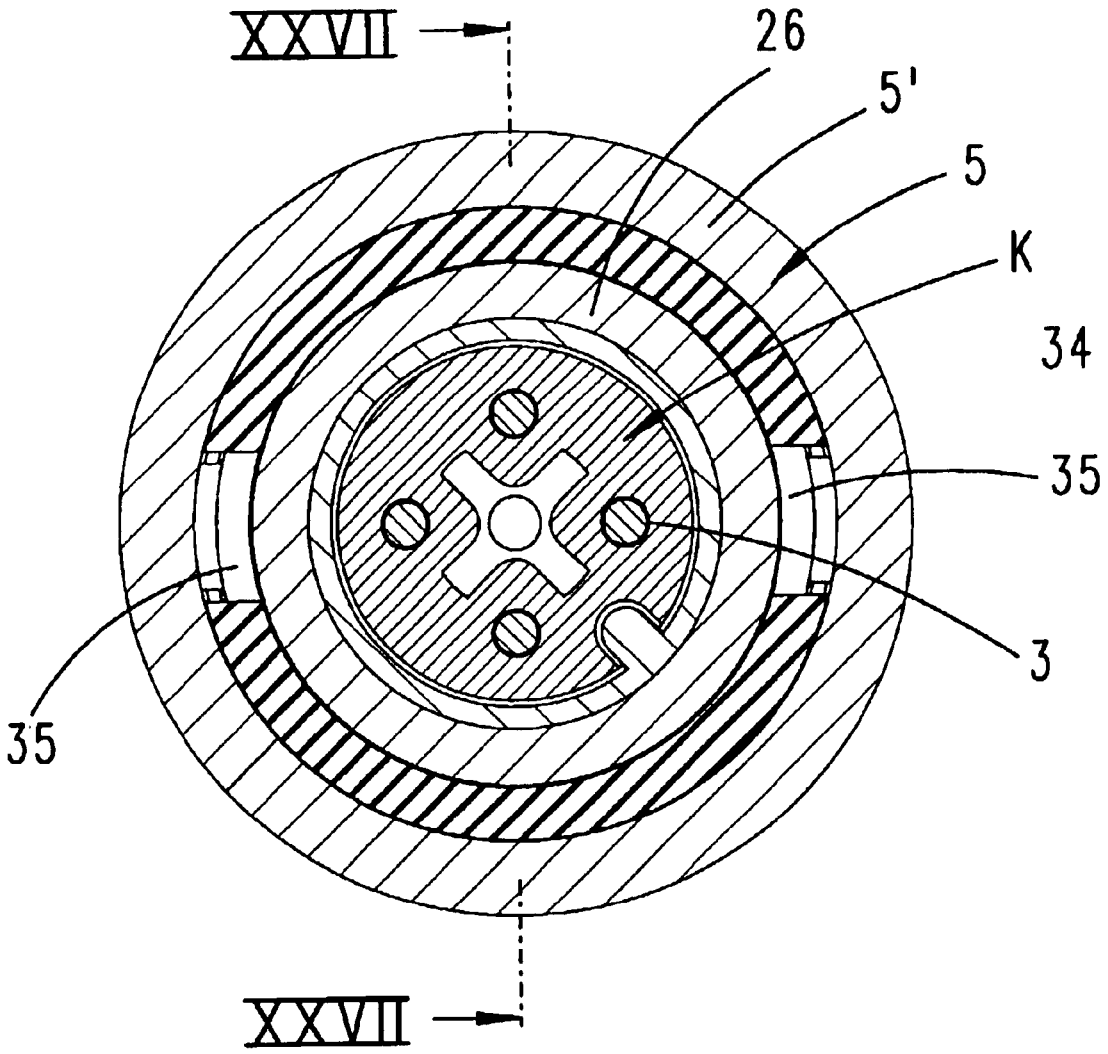
FIG. 25 shows the section along the line XXV—XXV in FIG. 24.
Figure 26:
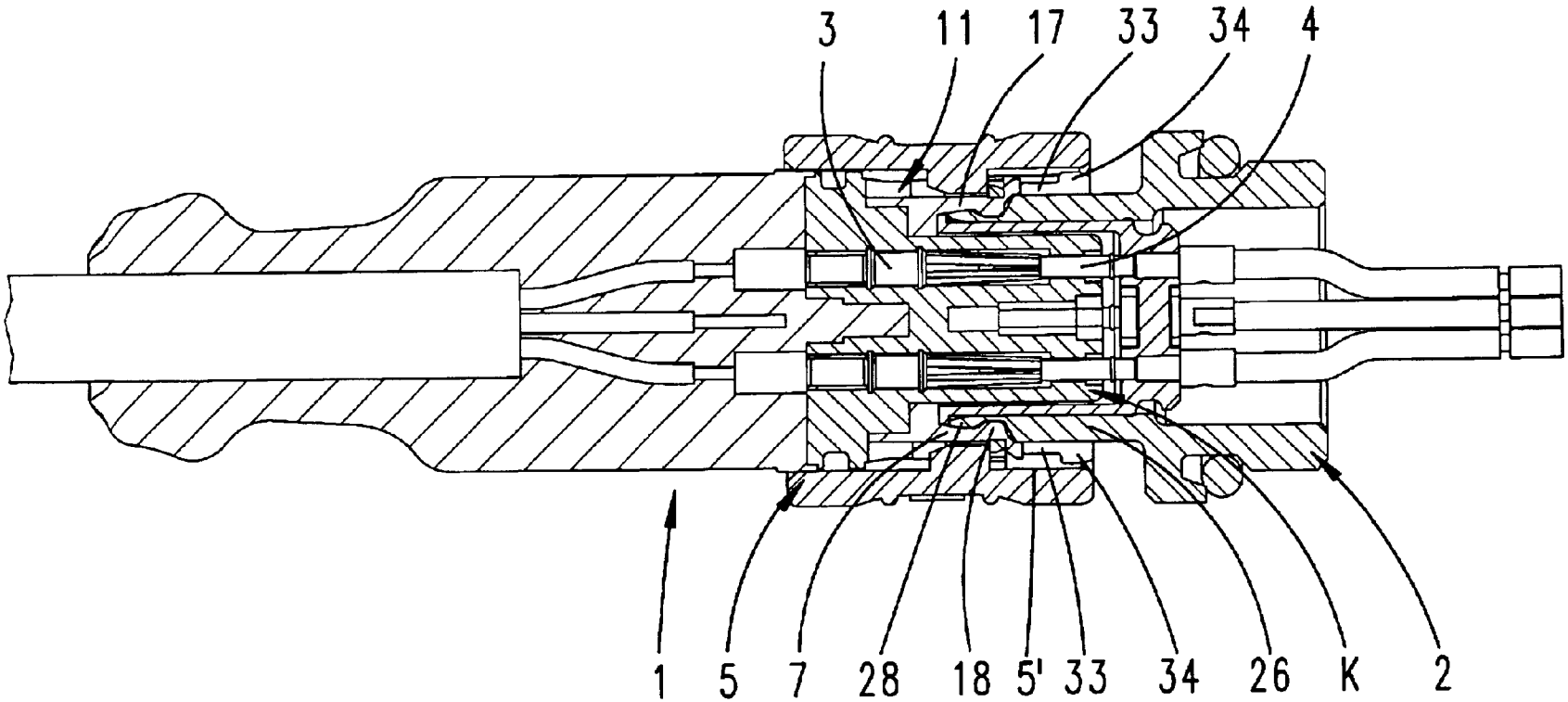
FIG. 26 shows the section along the line XXVI—XXVI in FIG. 24.

A second variant of a counter connector is represented in FIG. 18. This counter connector is also of a two-part form. This exemplary embodiment describes a male counter connector 2. The socket 6 consists of plastic and is formed on the outer part 37. The outer part forms an annular free space which surrounds the socket and has an internal thread 25. A sleeve 26, which forms the annular bead 27 which can be enclosed by the snap collar 18, is screwed into this internal thread 25.

All disclosed features are (in themselves) pertinent to the invention. The disclosure of the associated/accompanying priority documents (copy of the prior patent application) is also hereby incorporated in full in the disclosure of the patent application, including for the purpose of incorporating features of these documents in claims of the present application.

We claim:

1. Connector (1) for fitting onto a counter connector (2), contact elements (3) of the connector (1) entering into an electrical conducting connection with counter contact elements (4) of the counter connector (2), with a sleeve (7) which surrounds the contact elements (3) carried by a core (K) and forms a snap collar (18) for gripping behind a latching bead (27, 28) of the counter connector (2) and with a locking coupling (5) which, in a release position, allows radial escape of the snap collar (18) and, in a locking position, prevents it, wherein the core (K) is made of a harder plastic than a casing (17) surrounding the core (K) with a spacing and forms a sleeve portion (7) which has peripheral interruptions (8 and 9) and on inside of which the snap collar (18) of softer plastic is formed integrally with the casing (17).

2. Connector according to claim 1, wherein the entire inner side of the sleeve portion (7) of the core (K) is lined with soft plastic, but outer side is substantially free from soft plastic.

3. Connector according to claim 1, wherein the peripheral interruptions (9) comprise at least two slits (8), lying diametrically opposite each other, which are open toward an end face of the sleeve portion (7).

4. Connector according to claim 1, wherein there is at least one anchoring clearance (9) of the sleeve portion (7), which is filled with soft plastic.

5. Connector according to claim 1, wherein the connector part (1) is female or male.

6. Connector according to claim 1, wherein the core (K) has at least one guide (11) for the locking coupling (5), extending in direction of displacement of the locking coupling (5), said guide (11) has latching means (12, 13) at each end for latching the locking coupling (5) in its two end positions.

7. Connector according to claim 6, wherein the guide (11) is a groove or a window, with a central constriction (11'), into which a guide pin (21) of the locking coupling (5) engages.

8. Connector according to claim 7, further comprising a run-up slope (14), disposed ahead of the guide (11), for the guide pin (21), which is also provided with a run-up slope (22).

9. Connector according to claim 1, further comprising a locking shoulder (24), which runs partly around peripheral level with the guide pin (21) and in the locking position grips behind the snap collar (18), and in front of said locking shoulder (24) there lies a peripheral free space (U) of the locking coupling (5), in which an edge of the sleeve can escape radially.

10. Connector according to claim 1, wherein there is at least one through-flow opening (16) disposed between the sleeve (7) and a central region (Z) of the core (K), said region carrying the contact elements (3) and, particularly, is in form of a socket.

11. Connector according to claim 10, wherein there is an annular gap (29), which surrounds the central region (Z) and bottom (30) of which forms a soft plastic support (19), which extends over the through-flow opening (16) and is engaged by end edge (31) of a threaded sleeve (26) of the counter connector (2) having annular bead (27).

12. Connector according to claim 10, wherein the central region (Z) in the form of a socket forms a cup-shaped clearance for the insertion of a socket (6) of the counter connector (2), the socket (6) carrying the counter contact elements (4).

13. Connector (1) for fitting onto a counter connector (2), contact elements (3) of the connector (1) entering into an electrical conducting connection with counter contact elements (4) of the counter connector (2), with a sleeve (7) which surrounds the contact elements (3) carried by a core (K) and forms a snap collar (18) for gripping behind a latching bead (27, 28) of the counter connector (2) and with a locking coupling (5) which, in a release position, allows radial escape of the snap collar (18) and, in a locking position, prevents it, and an axial extension (33) of the sleeve (7) which, in the locking position of the locking coupling (5), is enclosed by the latter, wherein the core (K) is made of a harder plastic than a casino (17) surrounding the core (K) with a spacing and forms a sleeve portion (7) which has peripheral interruptions (8 and 9) and on inside of which the snap collar (18) of softer plastic is formed integrally with the casino (17).

14. Connector according to claim 13, wherein the axial extension (33) of the snap collar (18) is formed by casing (17).

15. Connector according to claim 13, further comprising an end bead (34), which is arranged to the extension (33) and extends in the circumferential direction.

16. Connector according to claim 13, wherein the bead (34) is enclosed by end portion (5') of the locking coupling (5) with a small spacing.

17. Connector according to claim 13, wherein the extension (33) is divided by two diametrically opposite axial slits (2).

18. Counter connector for a connector, the connector comprising: contact elements (3) entering into an electrical conducting connection with counter contact elements (4) of the counter connector (2), with a first sleeve (7) which surrounds the contact elements (3) carried by a core (K) and forms a snap collar (18) for gripping behind a latching bead (27, 28) of the counter connector (2) and with a locking coupling (5) which, in a release position, allows radial escape of the snap collar (18) and, in a locking position, prevents it, and an axial extension (33) of the first sleeve (7) which, in the locking position of the locking coupling (5), is enclosed by the latter, the counter connector having a second sleeve (26, 36), having a bottom, counter contact elements (4) coordinated to said bottom, wherein the rim of an opening of the second sleeve (26, 27) forms a latching bead (27, 28), wherein the second sleeve (26, 27) forms an inner sleeve (26), which is screwed into an outer sleeve a collar forming part of annular bead (27) rests on an end edge of the outer sleeve (36).

19. Counter connector according to claim 18, wherein the collar forming the annular bead (27) is adjoined by an annular bead portion (28) of the outer sleeve (36), which is adjoined by an annular clearance, for entry of a snap collar (18).

20. Plug-in connection comprising a connector (1) for fitting onto a counter connector (2), contact elements (3) of the connector (1) entering into an electrical conducting connection with counter contact elements (4) of the counter connector (2), with a sleeve (7) which surrounds the contact elements (3) carried by a core (K) and forms a snap collar (18) for gripping behind a latching bead (27, 28) of the counter connector (2) and with a locking coupling (5) which, in a release position, allows radial escape of the snap collar (18) and, in a locking position, prevents it, wherein the core (K) is made of a harder plastic than a casing (17) surrounding the core (K) with a spacing and forms a sleeve portion (7) which has peripheral interruptions (8 and 9) and on inside of which the snap collar (18) of softer plastic is formed integrally with the casing (17), and the plug-in connection further comprising a counter connector having a sleeve (26, 36) having a bottom, counter contact elements (4) coordinated to said bottom, wherein the rim of an opening of the sleeve (26, 27) forms a latching bead (27, 28).

21. Counter connector for a connector, the connector comprising: contact elements (3) entering into an electrical conducting connection with counter contact elements (4) of the counter connector (2), with a first sleeve (7) which surrounds the contact elements (3) carried by a core (K) and forms a snap collar (18) for gripping behind a latching bead (27, 28) of the counter connector (2) and with a locking coupling (5) which, in a release position, allows radial escape of the snap collar (18) and, in a locking position, prevents it, wherein the core (K) is made of a harder plastic than a casing (17) surrounding the core (K) with a spacing and forms a sleeve portion (7) which has peripheral interruptions (8 and 9) and on inside of which the snap collar (18) of softer plastic is formed integrally with the casing (17), the counter connector having a second sleeve (26, 36) having a bottom, counter contact elements (4) coordinated to said bottom, wherein the rim of an opening of the second sleeve (26, 27) forms a latching bead (27, 28), and wherein the second sleeve (26, 27) forms an inner sleeve (26), which is screwed into an outer sleeve (36), and a collar forming part of annular bead (27) rests on an end edge of the outer sleeve (36).

22. Counter connector according to claim 21, wherein the collar forming the annular bead (27) is adjoined by an annular bead portion (28) of the outer sleeve (36), which is adjoined by an annular clearance, for entry of a snap collar (18).

* * * * *